United States Patent [19]

Anderson

[11] 4,041,620

[45] Aug. 16, 1977

[54] INTEGRATED SHOE SOLE AND HEEL

[75] Inventor: Victor F. Anderson, Wenonah, N.J.

[73] Assignee: Shell Oil Company, Houston, Tex.

[21] Appl. No.: 718,232

[22] Filed: Aug. 27, 1976

[51] Int. Cl.[2] ..... A43B 13/04

[52] U.S. Cl. ..... 36/32 R

[58] Field of Search ..... 36/24.5, 34 A, 25 R, 36/32 R

[56] References Cited

U.S. PATENT DOCUMENTS

| | | | |
|---|---|---|---|
| 652,888 | 7/1900 | Butterfield | 36/32 R |
| 1,753,702 | 4/1930 | Griffiths | 36/24.5 X |
| 1,973,785 | 9/1934 | Walsh et al. | 36/34 A X |
| 2,281,390 | 4/1942 | Simon | 36/34 A |
| 2,887,794 | 5/1959 | Masera | 36/25 R |
| 3,363,343 | 1/1968 | Bourassa et al. | 36/32 R |

FOREIGN PATENT DOCUMENTS

| | | | |
|---|---|---|---|
| 1,476,115 | 2/1967 | France | 36/24.5 |
| 1,555,843 | 12/1968 | France | 36/24.5 |

*Primary Examiner*—Alfred R. Guest
*Attorney, Agent, or Firm*—Dean F. Vance

[57] ABSTRACT

An integrated shoe sole and heel article is disclosed having an integrated hollow heel and shank insert formed from a thermoplastic polymer, a heel-seat part closing the opening of the hollow heel, and a unit sole formed from a thermoplastic elastomeric composition encompassing the closed heel and shank insert. Also disclosed is the process for making the integrated shoe sole and heel article.

7 Claims, 3 Drawing Figures

INTEGRATED SHOE SOLE AND HEEL

BACKGROUND OF THE INVENTION

In the manufacture of footwear of various types, it is often a problem to develop a product having all the physical properties which are desired. A leather sole thick enough to protect the foot is expensive and often is too heavy for wearing comfort. A rubber sole shoe made of ordinary rubbers requires vulcanization and has a number of properties which are found to be disadvantageous in footwear.

Recently, synthetic rubber has begun to replace polyvinyl chloride, natural rubber, and leather for casual shoe soles and heels. These synthetic rubbers, such as the styrene-diene block copolymers of Hendricks et al. U.S. Pat. No. Re. 28,236, have a number of advantages. For one, these block copolymer compositions do not require a vulcanization step. Further, the scrap from these block copolymer shoes may be recycled since these polymers are clearly "thermoplastic" elastomers.

In order to reduce the weight and cost of the shoe sole and heel (unit sole), and to improve the cooling and cycle time involved in producing the unit sole, it has often been necessary to employ molds that result in a hollow core or cavity in the shoe heel. However, one of the major problems with injection molded unit soles is that the method of fabrication and its material of construction produce a hollow core module that does not generally provide sufficient structural rigidity to support the various heel heights or the shank area of today's modern casual shoe. Thus, considerable flexing, bulging and shoe deformation can and does occur in these critical load areas of the shoes when worn.

SUMMARY OF THE INVENTION

The present invention covers a novel integrated shoe sole and heel that exhibits a much improved rigidity over the prior art unit soles, while at the same time retaining the necessary elastomeric characteristics of the prior art. Specifically the present invention is an integrated shoe sole and heel article comprising:

a. an integral heel and shank insert formed from a thermoplastic polymer wherein
   i. the heel portion comprises a hollow body part having a bottom and sides, the lower portions of which sides are continuous with the bottom and the upper portions of which sides bound an opening at the heel-seat area of the heel portion; and
   ii. the shank portion is continuous with the upper portion of the heel portion;
b. a heel-seat part closing the opening of the hollow body part of the heel portion, said heel-seat part being bonded to the heel portion and said heel-seat part having a means to suspend the integral heel and shank insert with attached heel-seat part in a unit sole mold; and
c. a unit sole formed from a thermoplastic elastomeric composition, said unit sole encompassing the integral heel and shank insert with attached heel-seat part.

The process for making the integrated shoe sole and heel comprises the steps of:

a. forming an integral heel and shank insert from a thermoplastic polymer wherein
   i. the heel portion comprises a hollow body part having a bottom and sides, the lower portions of which sides are continuous with the bottom and the upper portions of which sides bound an opening at the heel-seat area of the heel portion; and
   ii. the shank portion is continuous with the upper portion of the heel portion;
b. forming a heel-seat part for closing the opening of the hollow body part of the heel portion, said heel-seat part having a means to suspend the heel-seat part with attached heel and shank insert in a unit sole mold;
c. bonding the heel-seat part to the heel portion of the heel and shank insert so as to close said opening;
d. suspending the heel and shank insert with attached heel-seat part in a unit sole mold; and
e. forming an integrated shoe sole and heel by injecting a thermoplastic elastomeric composition into said unit sole mold such that the thermoplastic elastomeric composition flows around and encompasses the integral heel and shank insert with attached heel-seat part.

These integrated unit soles have a number of advantages over the prior art unit soles. Other than the improved rigidity already mentioned, the present invention presents great latitude in the method for preparing the heel and sole. For example, a single design for the integral heel and shank could be employed with a wide variety of unit sole designs. Further, various types of thermoplastic polymers may be employed for the integral heel and shank insert, as may be a wide range of thermoplastic elastomeric compounds for the unit sole.

DETAILED DESCRIPTION OF THE DRAWINGS

The process and article of this invention will become apparent to those skilled in the art from reading the following description taken in conjunction with the accompanying drawings in which like-reference characters refer to like parts throughout the several views.

Figure 1:
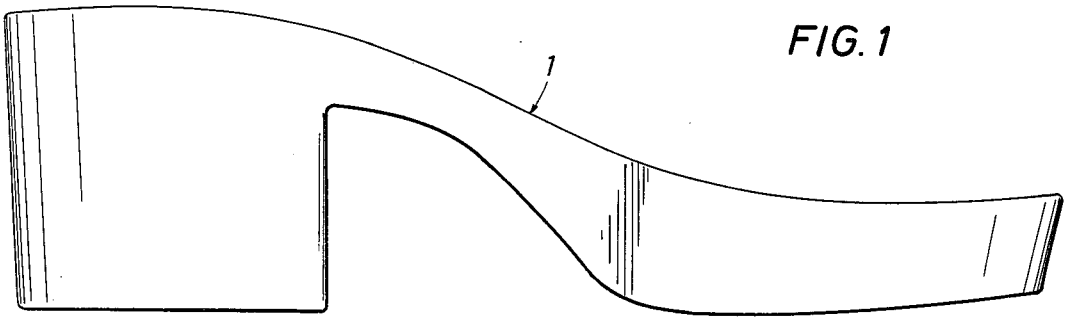
FIG. 1 is a side view of the finished integrated shoe sole and heel article.

Referring to FIG. 1, the finished integrated shoe sole and heel article (1) of the instant invention appears outwardly to be no different from a prior art unit sole. In fact, the unit sole produced by the instant invention is attached to a shoe upper in the same manner as the prior art unit sole. However, a prior art unit sole having a hollow heel and the heel height shown in FIG. 1 would not be sufficiently rigid for customer use. If the prior art unit sole had a solid heel, the weight and cost of the unit sole would be excessive. Accordingly, the instant invention offers distinct advantages over the prior art for shoes having high heels.

Figure 2:
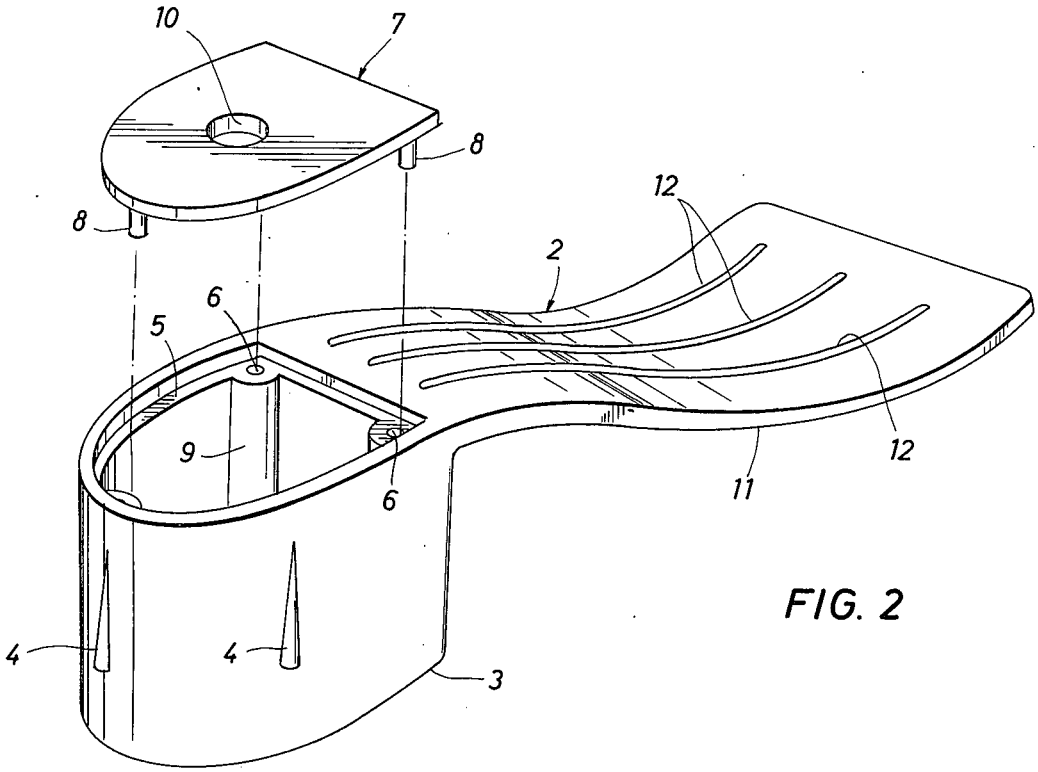
FIG. 2 is an exploded view of the heel and shank insert and the heel-seat part.

Referring to FIG. 2, an integral heel and shank insert 2 is fabricated from an injection moldable thermoplastic material, such as polystyrene or polypropylene. This insert, however, can also be fabricated through solid phase forming, casting or metal die forming. Further, the material of construction can vary to meet the individual requirements of the proposed fabrication technique.

The heel portion 3 as shown has a hollow cavity or body part of any shape essential to meet the requirements of the individual shoes esthetics, shape or function. The heel portion can have splines 4 or any type moldable appendages around its outer peripheral surface to secure it to the molded unit sole heel area. The heel 3 is closed on the bottom and open on the top (heel seat area). The top opening is equipped with an off-set flange area 5 and three hollow sockets 6. The flange and hollow sockets are made to receive a matching cover or heel-seat part 7. The cover is equipped with a matching flange seat and post pins 8 for the mating sockets. The number, size and shape of these post pins and sockets can vary as required. It is also possible to eliminate the flange areas, sockets and post pins if desired and still practice the instant invention. Further, structural ribbing 9 can be introduced into the hollow heel cavity for additional structural rigidity.

The cover 7 is attached to the heel opening by solvent welding, ultrasonic welding, hot staking or friction fit. The cover also indicates an additional opening 10, which is used to attach the insert part to the mold core, that is, to suspend the integral heel and shank insert with attached heel-seat part in a unit sole mold. Other means may be employed to suspend the insert in the mold, such as an appendage or appendages. This means of suspending the insert is necessary so that when the mold is closed during its operating cycle, the insert is suspended in a manner that permits the thermoplastic rubber to flow around the heel and shank insert, providing total coverage and yielding a relatively uniform wall thickness to the unit sole.

The structural heel insert also shows as an integral part an angular appendage 11 that protrudes from the heel's breast top edge, which makes up a cantilever support contoured to represent a shoe's shank. This shoe shank shows several structural ribs 12. The size, shape and number of ribs in this shank portion can be varied as desired. Further, these ribs could be replaced by various size, shape and number of geometric openings or aperatures. These openings would permit the thermoplastic rubber when injected into the mold cavity to flow through and around the suspended insert, thus providing even a greater structural bond surface between the heel and shank insert and the unit sole.

Figure 3:
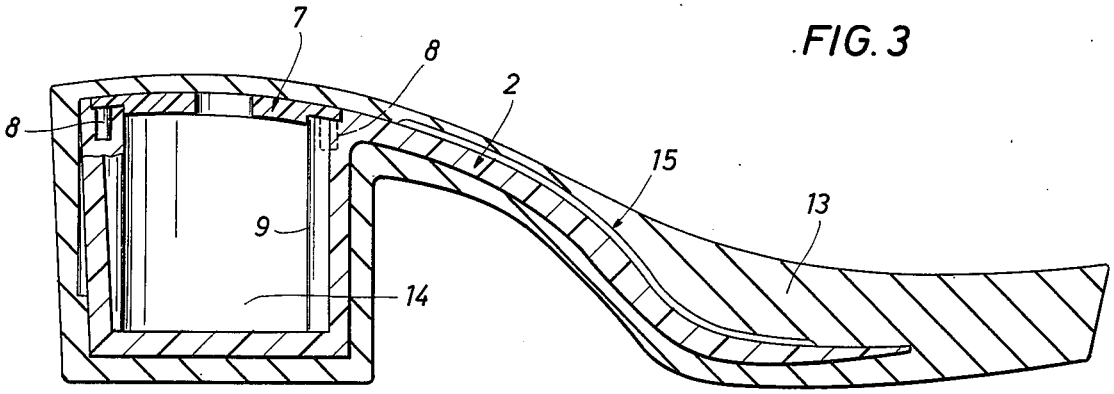
FIG. 3 is a cross-sectional view of the finished integrated shoe sole and heel article.

FIG. 3 reveals a cross-sectional view of the finished unit sole taken on line A—A of FIG. 1. As can be seen, the thermoplastic rubber 13 encompasses the integral heel and shank 2. The hollow cavity 14 greatly reduces the weight of the unit sole and also reduces the cooling required in order to remove the unit sole from the mold. Also noted in the cross-sectional view are the structural ribs 9, the posts 8, and the heel cap 7. Also shown is an optional contoured arch support 15 which could be attached onto the shank upper surface area. This additional support could be fabricated from any injection moldable thermoplastic material and would provide additional support.

DETAILED DESCRIPTION OF THE INVENTION

As stated above, the integral heel and shank insert may be fabricated from any injection moldable thermoplastic material. Examples of suitable thermoplastic materials include polystyrenes, polyethylene, polypropylene, ABS polymers, polyesters, and polyamides. Preferred thermoplastic materials are polystyrenes (both high impact and crystal grade polystyrene) and polypropylene. Much preferred because of its ready availability and rigidity is polystyrene.

The thermoplastic rubbers employed are preferably the block polymers and their compounds as described in U.S. Pat. No. Re. 28,236, which is herein incorporated by reference. See also U.S. Pat. No. 3,870,676 and various other U.S. and foreign patents describing these block copolymers. The block polymers employed in the instant invention are block copolymers of monoalkenyl arenes and conjugated dienes. Preferred block polymers are styrene-butadiene-styrene block copolymers and styrene-isoprene-styrene block copolymers. These block copolymers are typically blended with other resins and fillers such as polystyrene, rubber extending oils and clay or calcium carbonate.

It is especially preferred that the heel and shank insert be fabricated from polystyrene and the unit sole be fabricated from a styrene-butadiene-styrene block copolymer. In that case, the block copolymer bonds to the polystyrene insert with almost a one-hundred percent adhesion when the thermoplastic molding temperature is over 350° F.

What is claimed is:

1. An integrated shoe sole and heel article comprising:

a. an integral heel and shank insert formed from a thermoplastic polymer wherein i. the heel portion comprises a hollow body part having a bottom and sides, the lower portions of which sides are continuous with the bottom and the upper portions of which sides bound an opening at the heel-seat area of the heel portion; and ii. the shank portion is continuous with the upper portion of the heel portion;

b. a heel-seat part closing the opening of the hollow body part of the heel portion, said heel-seat part being bonded to the heel portion and said heel-seat part having a means to suspend the integral heal and shank insert with attached heel-seat part in a unit sole mold; and c. a unit sole formed from a thermoplastic elastomeric composition, said unit sole encompassing the integral heel and shank insert with attached heel-seat part.

2. An article according to claim 1 wherein said thermoplastic polymer is selected from the group consisting of polystyrene and polypropylene and wherein said thermoplastic elastomeric composition contains a monoalkenyl arene-diene block copolymer component.

3. An article according to claim 2 wherein said thermoplastic polymer is polystyrene and said monoalkenyl arene-diene block copolymer is a styrene-butadiene block copolymer.

4. An article according to claim 1 wherein the exterior sides of the heel portion of the integral heel and shank insert are provided with reinforcing ribs.

5. An article according to claim 1 wherein the shank portion of the integral heel and shank insert is provided with reinforcing ribs.

6. An article according to claim 1 wherein the shank portion of the integral heel and shank insert has at least one aperature.

7. An article according to claim 1 wherein the heel portion of the integral heel and shank insert at the heel-seat area is provided with a means for holding the heel and shank insert and the heel-seat part in assembled relation when the heel-seat part closes the opening.

* * * * *